US009169798B2

(12) United States Patent
Valencia et al.

(10) Patent No.: US 9,169,798 B2
(45) Date of Patent: Oct. 27, 2015

(54) VALVE COVER WITH INTEGRATED SPARKPLUG TUBE

(71) Applicant: Ford Global Technologies, LLC, Dearborn, MI (US)

(72) Inventors: Frank Acierno Valencia, Canton, MI (US); Paul Thomas Reinhart, Livonia, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 13/706,248

(22) Filed: Dec. 5, 2012

(65) Prior Publication Data

US 2014/0150746 A1 Jun. 5, 2014

(51) Int. Cl.

| | |
|---|---|
| ***F01M 9/10*** | (2006.01) |
| ***H01T 13/00*** | (2006.01) |
| ***H01T 13/02*** | (2006.01) |
| ***F02F 1/24*** | (2006.01) |
| *F01M 13/04* | (2006.01) |
| *F01L 1/46* | (2006.01) |
| *F01L 1/12* | (2006.01) |

(52) U.S. Cl.

CPC . *F02F 1/242* (2013.01); *F01L 1/12* (2013.01); *F01L 1/46* (2013.01); *F01M 13/0416* (2013.01)

(58) Field of Classification Search

CPC . F02F 7/006; F02B 2275/34; F01M 13/0416; F01L 1/12; F01L 1/46

USPC ..... 123/90.38, 143 C, 169 PH, 169 P, 169 PA

See application file for complete search history.

(56) References Cited

U.S. PATENT DOCUMENTS

| | | | | |
|---|---|---|---|---|
| 2,238,397 | A * | 4/1941 | Rabezzana | 439/126 |
| 2,686,509 | A * | 8/1954 | Drinkard | 123/143 C |
| 5,003,958 | A * | 4/1991 | Yoneyama et al. | 123/635 |
| 5,323,740 | A | 6/1994 | Daily et al. | |
| 6,437,674 | B1 | 8/2002 | Hamer et al. | |
| 7,310,037 | B2 | 12/2007 | Skinner et al. | |
| 2004/0104796 | A1 | 6/2004 | Kawai et al. | |
| 2008/0276918 | A1 | 11/2008 | Skinner et al. | |

FOREIGN PATENT DOCUMENTS

| | | | |
|---|---|---|---|
| CN | 201925042 U | * | 8/2011 |

* cited by examiner

*Primary Examiner* — Lindsay Low
*Assistant Examiner* — Charles Brauch
(74) *Attorney, Agent, or Firm* — Julia Voutyras; Alleman Hall McCoy Russell & Tuttle LLP

(57) ABSTRACT

A valve cover for an engine and a method is provided. The valve cover may include a cover body, and a sparkplug tube formed integrally with the cover body. In this way, any distortion of the bottom end of the sparkplug tubes due to, for example removal and reinstallation may not provide a leakage path.

20 Claims, 5 Drawing Sheets

VALVE COVER WITH INTEGRATED SPARKPLUG TUBE

FIELD

The present disclosure relates generally to valve covers for internal combustion engines, for example a valve cover with an integrated spark plug tube.

BACKGROUND AND SUMMARY

The spark plugs of an internal combustion engine may be located in a sparkplug well at, or near, the top of a cylinder head. A valve cover may be attached to the cylinder head, and may be configured to house engine components such as cam rods, and an oil separator. The components under the valve cover may be kept well oiled. Elongate passages referred to as a spark plug tubes may used in order to keep the oil in the valve cover from contacting the sparkplugs. Electrical connectivity from the electrical system of the vehicle to each spark plug may be made via a corresponding number of Coils On Plug (COPs) positioned in each spark plug tube, and accessible from a top surface of the valve cover. First, or bottom, ends of respective sparkplug tubes may be press fitted into each sparkplug well. Ring shaped radial lip seals, or tube seals, may be used to seal the junction between the valve cover and a second, or top, end of each sparkplug tube.

The inventors herein have recognized three possible paths by which oil may travel from under the valve cover to one or more sparkplugs. The first is between the cylinder head and sparkplug tube; the second is between the radial lip seal and valve cover; and the third is between the radial lip seal and the spark plug tube.

One attempt to keep oil from contacting the sparkplugs is disclosed in US patent publication US 2008/0276918 to Skinner et al. The disclosed approach attempts to eliminate the use of the sparkplug tubes by providing an ignition apparatus with an oil seal integrated with a spark plug boot and configured to mate directly with the cylinder head. A first sealing arrangement is configured to seal the ignition apparatus to the valve cover. A second sealing arrangement includes a circular recessed ring cavity added to the cylinder head circumscribing the spark plug.

The inventors herein have recognized a number of issues with this approach. For example, the cylinder head is modified by adding the ring cavity to receive the annular sealing rib on the bottom end of the disclosed ignition apparatus to form the second sealing arrangement. In addition the ignition apparatus disclosed includes seams along its length that may create additional vulnerabilities to leakage.

The inventors herein have developed a valve cover for an engine that may include a cover body, and a sparkplug tube formed integrally with the cover body. In this way, possible leakage paths between the cylinder head and sparkplug tube or between the radial lip seal and valve cover may be reduced.

One embodiment may include a sealing arrangement on or adjacent a distal end of the sparkplug tube for sealing with a cylinder head. The sealing arrangement may be, for example, an O-ring groove and an O-ring configured for sealing engagement with an annular surface of the sparkplug well in the cylinder head. In this way, any distortion of the bottom end of the sparkplug tubes due to, for example removal and reinstallation may not provide a leakage path. Also in this way, conventional COPs may be used, and the cylinder head may not need modification.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2-7 are drawn to scale, although other relative dimensions may be used.

DETAILED DESCRIPTION

Figure 1:
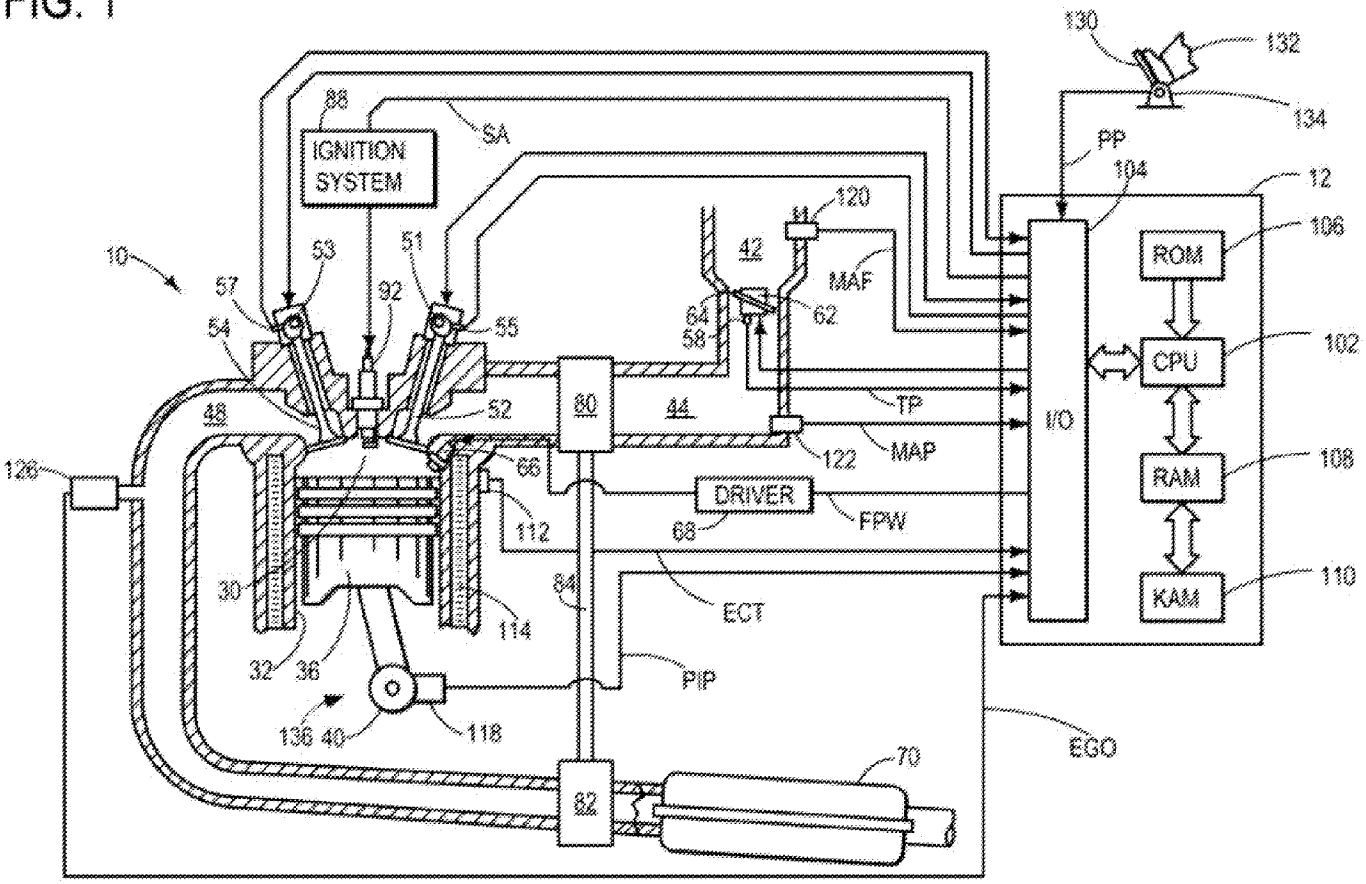
FIG. 1 shows a schematic depiction of an internal combustion engine.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57.

Intake manifold 44 is also shown intermediate of intake valve 52 and air intake zip tube 42. Fuel is delivered to fuel injector 66 by a fuel system (not shown) including a fuel tank, fuel pump, and fuel rail (not shown). The engine 10 of FIG. 1 is configured such that the fuel is injected directly into the engine cylinder, which is known to those skilled in the art as direct injection. Fuel injector 66 is supplied operating current from driver 68 which responds to controller 12. In addition, intake manifold 44 is shown communicating with optional electronic throttle 62 with throttle plate 64. In one example, a low pressure direct injection system may be used, where fuel pressure can be raised to approximately 20-30 bar. Alternatively, a high pressure, dual stage, fuel system may be used to generate higher fuel pressures. Additionally or alternatively a fuel injector may be positioned upstream of intake valve 52 and configured to inject fuel into the intake manifold, which is known to those skilled in the art as port injection.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by foot 132; a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 58.

In a process hereinafter referred to as ignition, injected fuel is ignited by an ignition source, such as spark plug 92, resulting in combustion.

Engine 10 may further include a turbocharger having a compressor 80 positioned in intake manifold 44 coupled to a turbine 82 positioned in exhaust manifold 48. A driveshaft 84 may couple the compressor to the turbine. Thus, the turbocharger may include compressor 80, turbine 82, and driveshaft 84. Exhaust gases may be directed through the turbine, driving a rotor assembly which in turn rotates the driveshaft. In turn the driveshaft rotates an impeller included in the compressor configured to increase the density of the air delivered to combustion chamber 30. In this way, the power output of the engine may be increased. In other embodiments, the compressor may be mechanically driven and turbine 82 may not be included in the engine. Further, in other examples, engine 10 may be naturally aspirated.

Figure 2:
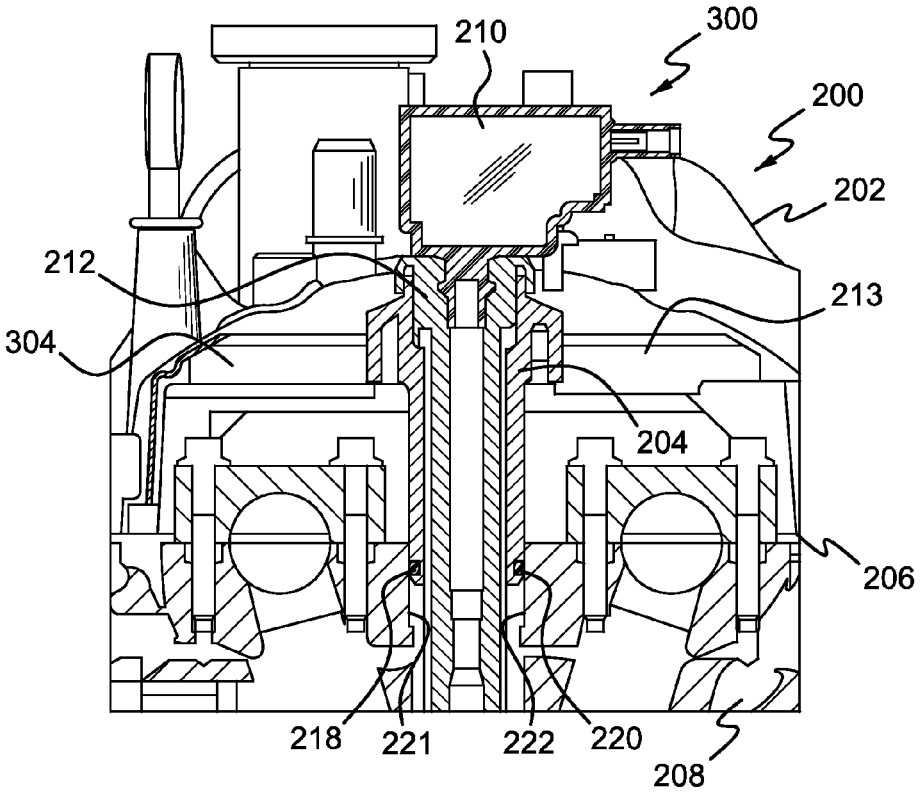
FIG. 2 is partial cross-sectional view of an example valve cover in accordance with the present disclosure.

FIG. 2 is partial cross-sectional view of an example valve cover 200 in accordance with the present disclosure. The valve cover 200 may be for an engine 10, such as the engine 10 illustrated in FIG. 1. The valve cover 200 may include a cover body 202 and a sparkplug tube 204 formed integrally with the cover body 202. It will be appreciated that the formation of the sparkplug tube with the cover body achieves new functions not achieved by the components separately. For example, previous spark plug tubes used to seal oil from the spark plug have three oil leak paths as noted above. Leaking oil into the spark plug may cause performance issues or degradation of the spark plug. By integrating the tube with the cam cover, two oil leak paths are reduced (e.g., from the radial lip seal to the cover, and from the radial lip seal to the tube). The remaining path (between tube and cylinder head) may be advantageously addressed via an o-ring or face seal that provides a simplified structure overall. For example, the new structure may eliminate a spark plug tube and radial lip seal joint. Further still, a new function is provided that improves the sealing of the COP boot, without any modifications required to the cylinder head or COP housing. Further still, the new structure also provides for the new feature of reduced installation force to install the valve cover onto the cylinder head, potentially zero force. Additionally, valve cover fasteners may be used to seat the "molded-in" tube. Additionally, in order to accommodate the integral formation, further additional structural features and modifications may be included.

Figure 3:
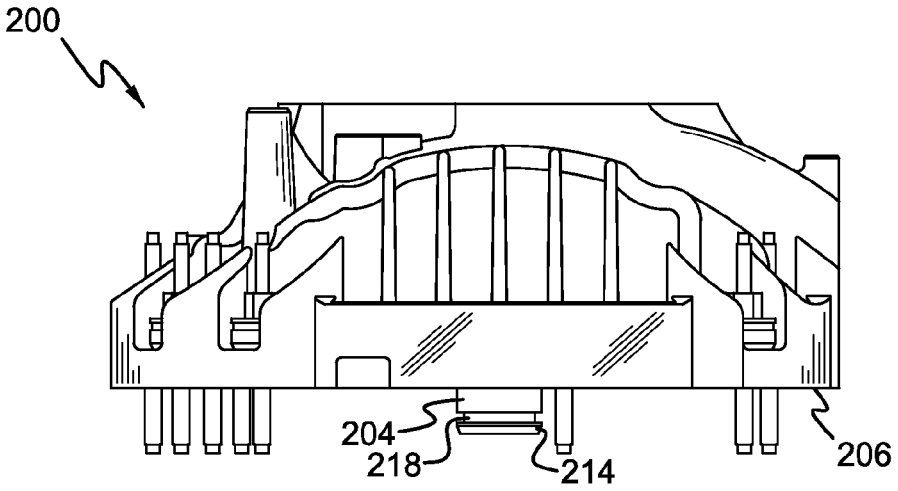
FIG. 3 is side view of the example valve cover shown in FIG. 2.
Figure 4:
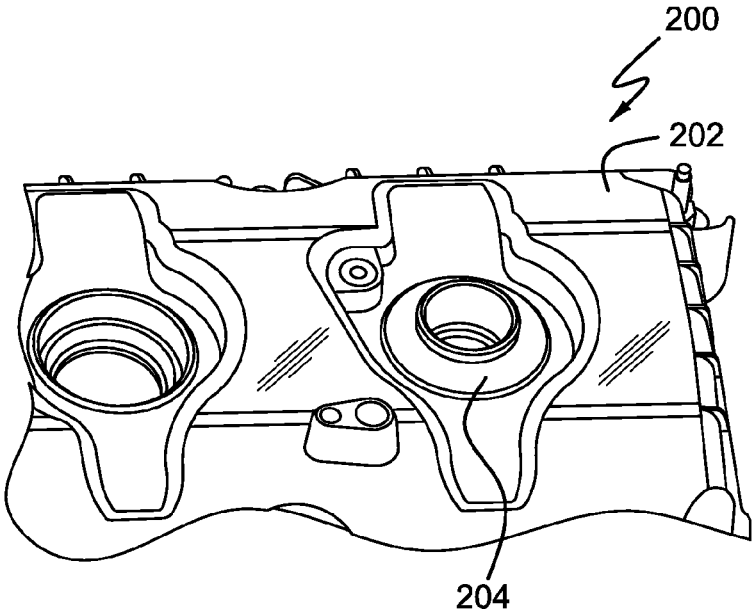
FIG. 4 is top perspective view of a portion of the valve cover shown in FIG. 2.
Figure 5:
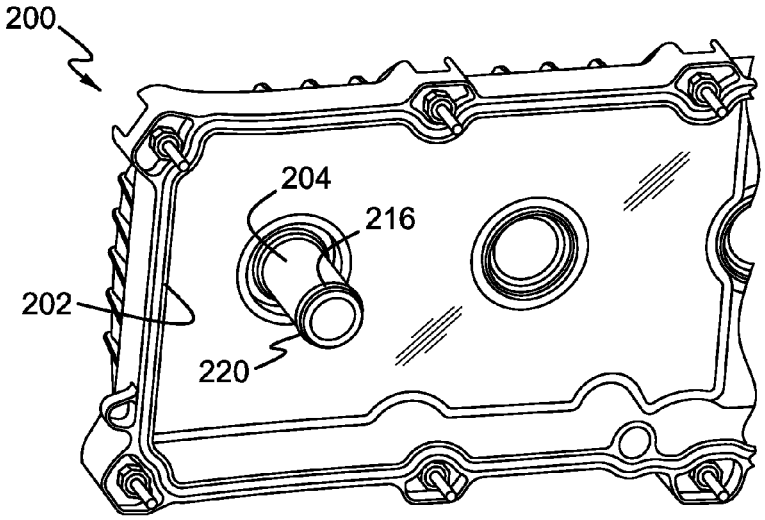
FIG. 5 is bottom perspective view of a portion of the valve cover shown in FIG. 2.

FIG. 3 is side view of the example valve cover shown in FIG. 2. FIG. 4 is top perspective view, and FIG. 5 is bottom perspective view, of a portion of the valve cover shown in FIG. 2. In some cases the cover body 202 may include a coupling edge 206 for coupling with a cylinder head 208 (FIG. 2). The sparkplug tube 204 may extend past the coupling edge 206. The coupling edge 206 may be substantially located in a plane as shown in the illustrated example. In other examples the coupling edge 206 may be in another shape. The cylinder head 208 may include bores in which intake valve 52 and exhaust valve 54 may be disposed for operation as discussed above and as illustrated in FIG. 1.

Figure 6:
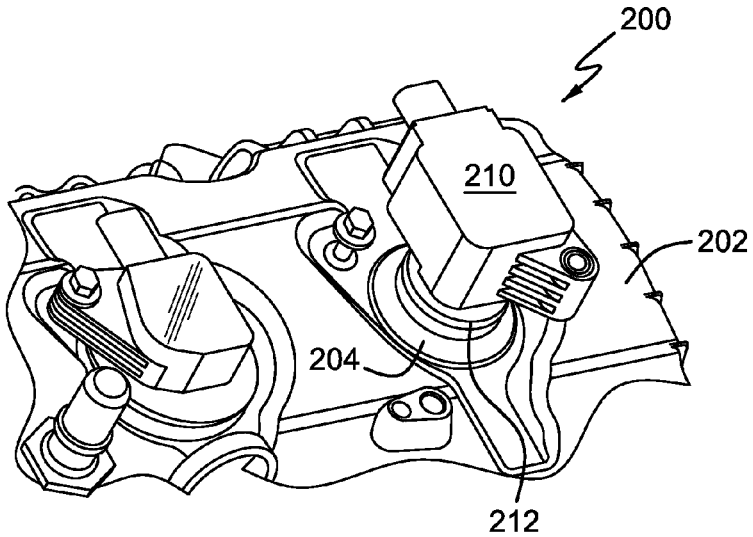
FIG. 6 is top perspective view of a portion of the valve cover shown in FIG. 2 with a Coil On Plug (COP) located within a sparkplug tube.

FIG. 6 is top perspective view of a portion of the valve cover shown in FIG. 2. A top portion, or boot 210 of a Coil On Plug (COP) 212 is shown extending partway out of the sparkplug tube 204. The Coil On Plug (COP) 212 may be attached to a spark plug 92 which may be electrically coupled to the ignition system 88 of the engine 10 (FIG. 1).

The sparkplug tube 204 may include a sealing arrangement 216 on or adjacent a distal end 214 thereof for sealing with the cylinder head 208. FIG. 5 illustrates an example, wherein the sealing arrangement 216 may include an O-ring groove 218 and an O-ring 220 configured for sealing engagement with an annular surface 221 of a sparkplug well 222 (FIG. 2) in the cylinder head 208.

Figure 7:
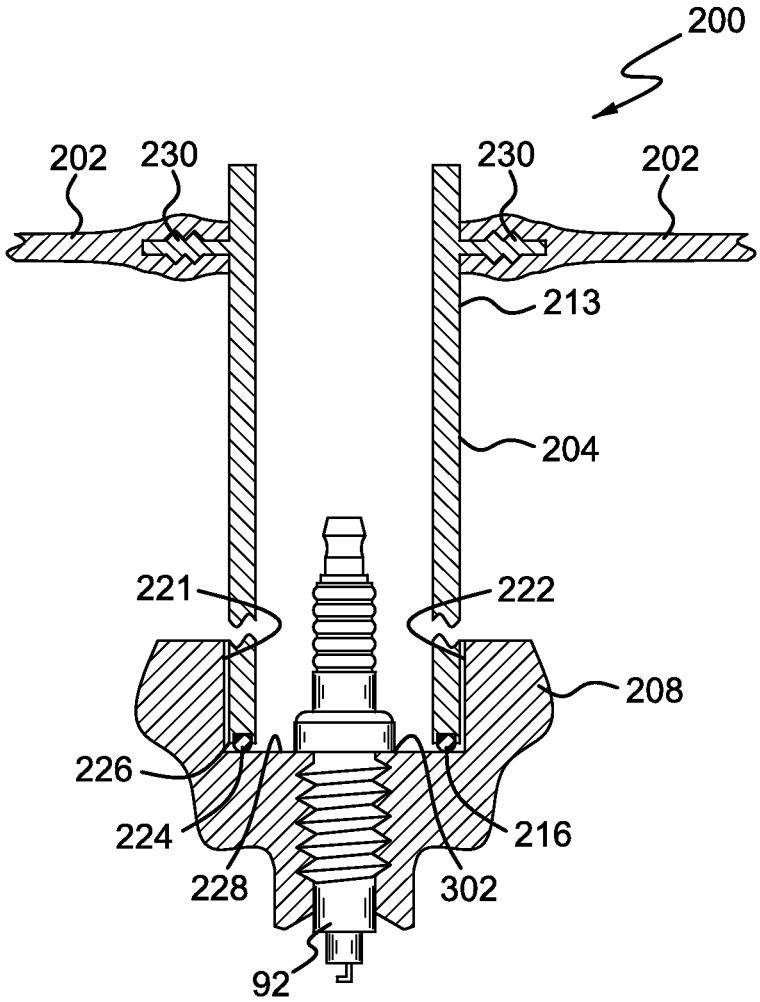
FIG. 7 is partial sectional view of another example valve cover in accordance with the present disclosure.

FIG. 7 is partial sectional view of another example valve cover in accordance with the present disclosure. FIG. 7 also illustrate another example sealing arrangement 216 which may includes a face seal 224 which may be disposed on an edge 226 of the sparkplug tube 204 and configured for sealing engagement with a base 228 of a sparkplug well 222.

The sparkplug tube 204 may be molded-into the cover body 202, or be a molded-in piece. For example, the sparkplug tube 204 and the cover body 202 may be formed together in a single molding operation. In some examples the sparkplug tube 204 may be an insert piece placed into a mold cavity prior to molding the cover body 202. In this way, the junction between the sparkplug tube 204 and the cover body 202 may not become a possible oil leakage path. As illustrated in FIG. 7 in some cases the spark plug tube 204, or tubes, may include a bonding, or coupling element 230. In this way the material that may be placed in the mold, by for example an injection molding operation, may bond to a relatively large surface to aid in coupling between the sparkplug tube 204 and the cover body 202.

With some embodiments the cover body 202 may comprises a first material and the sparkplug tube 204 may comprise a second material. The first material may be different from the second material. For example, the first material may be a material selected, for example, for mold-ability, and the second material may be selected, for example, for heat resistance or the like. In some cases the first material may be the same as the second material.

Some embodiments may provide a valve cover 200 including a covering body 202. The covering body 202 may have a coupling edge 206 configured to couple with a cylinder head 208 of an engine 10. The valve cover 200 may also include an enclosed passage 204 having a second end 213 fixedly coupled with the covering body and a first end 214 for sealing engagement with a sparkplug well 222 formed in the cylinder head 208. The enclosed passage 204 may be tube shaped, or be a tube. The first end 214 of the enclosed passage 204 may include an O-ring 220 configured to sealingly engage with an annular surface 221 of the sparkplug well 222.

Some embodiments may provide a system 300 (FIG. 2) for an engine 10. The system 300 may include a sparkplug attachment site 302 (FIG. 7) on a cylinder head 208. A valve cover 200 may be coupled to the cylinder head 204 at least partially enclosing a volume 304 between the valve cover 200 and the cylinder head 204. The system 300 may also include at least one sparkplug tube 204 having a first end 214 with an edge 226 disposed to circumscribe the spark plug attachment site 302. The at least one sparkplug tube 204 may also have a second end 213 molded-in to the valve cover 200.

The system 300 may include a seal 216 on the first end 214 of the sparkplug tube 204 configured to inhibit movement of oil from inside the volume 304 to the sparkplug attachment site 302. The cylinder head 204 may include a sparkplug well 222 around the sparkplug attachment site 302. An O-ring groove 218 may be formed at or near the first end 214 of the sparkplug tube 204. The O-ring groove 218 may include an O-ring 220 sealingly engaged with an annular surface 221 of a sparkplug well 222 included in the cylinder head 208. In some examples, the system 300 may include a face seal 224 on the edge 226 of the sparkplug tube 204 for sealingly contacting the cylinder head around the attachment site 302.

The sparkplug tube 204 may extend below the valve cover 200 and into the sparkplug well 222 formed into the cylinder head 208. The sparkplug tube 204 may be inserted into the sparkplug well 222 with a zero insertion force.

The system 300 may also include two or more fastening elements 306 on the valve cover 200 which may be positioned to mate with corresponding two or more fastening elements on the cylinder head 208 to orient the valve cover 200 onto the cylinder head 208 thereby locating the sparkplug tube 204 over the sparkplug attachment site 302.

Various embodiments may include a method of forming a valve cover for an internal combustion engine. The method may include positioning at least a portion of one or more tubes into a mold, and molding a cover body in the mold. In this way a molded valve cover may be formed to include the one or more tubes integrally coupled with the cover body. In some cases, the one or more tubes may be referred to as molded-in, or molded-into the valve cover. The positioning of at least a portion of the one or more tubes into the mold may include positioning two or more tubes into the mold. Four or more of tubes may be used, for example six tubes, or eight tubes.

Various methods may include providing an O-ring groove adjacent a first end of each of the one or more tubes. In this way, a seal between the sparkplug tube(s) and the sparkplug well(s) may be formed without, for example, an interference fit between mating metal parts.

Various embodiments may include positioning a mating edge of the valve cover adjacent a mating surface of the cylinder block while positioning ends of the one or more tubes into corresponding one or more sparkplug wells. The positioning the ends of the one or more tubes into the corresponding one or more sparkplug wells may include using two or more fasteners configured to fasten the valve cover to the cylinder block thereby to registering the one or more tubes with the one or more sparkplug wells. The fasteners may be for example a bolt and nut arrangement, or the like. In this way installation of the valve cover may be made easier, or accomplished more quickly.

In some cases the positioning of the ends of the one or more tubes into the corresponding one or more sparkplug wells may be done with a zero insertion force. This may also make installation easier, or quicker. In some cases the fit between the sparkplug tube(s) and the sparkplug well(s) may be such that a more considerable force may be used.

It will be appreciated that the configurations and methods disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A valve cover for an engine comprising:

an integral structure including a cover body and a sparkplug tube formed integrally with and molded-into the cover body, a sealed joint between the sparkplug tube and cover body eliminated, the sparkplug tube extending below a cylinder head coupling edge of the cover body, the sparkplug tube including a seal on a distal end thereof for sealing an outside of the sparkplug tube with an interior surface of a sparkplug well formed inside a cylinder head, the distal end positioned below the cylinder head coupling edge, where the seal includes an O-ring configured for sealing engagement with an annular surface of the sparkplug well formed inside the cylinder head;

a Coil On Plug (COP) located in the sparkplug tube and extending partway out of; and a COP boot sealingly coupled inside the COP.

2. The valve cover of claim 1, wherein the COP couples to a top outer edge of the sparkplug tube and wherein the COP boot extends above a top of the COP and the cover body.

3. The valve cover of claim 2, wherein the cover body comprises a first material and the sparkplug tube comprises a second material, wherein the first material is different from the second material.

4. The valve cover of claim 1, wherein the seal further includes an O-ring groove in an outer surface of the sparkplug tube, where the O-ring groove receives the O-ring.

5. The valve cover of claim 2, wherein the cylinder head coupling edge of the cover body is a substantially planar mating edge for mating and coupling with a mating surface of the cylinder head, the sparkplug tube extending below the cylinder head coupling edge and into a sparkplug well of the cylinder head when the cylinder head is coupled to the cylinder head coupling edge.

6. A valve cover comprising:

a covering body having a coupling edge configured to couple with a cylinder head of an engine; and an enclosed passage having a second end fixedly coupled with the covering body and a first end extending out a bottom of the covering body and below the coupling edge, the first end including a seal for sealing engagement between an outside of the enclosed passage and a sparkplug well formed inside the cylinder head, where the seal is configured to be disposed between the outside of the enclosed passage and the sparkplug well, the enclosed passage integrated and molded-in with the covering body, a sealed joint between the enclosed passage and the covering body eliminated, a top outer edge of the enclosed passage coupled to a Coil On Plug (COP).

7. The valve cover of claim 6, wherein the seal includes an O-ring configured to sealingly engage with an interior annular surface of the sparkplug well.

8. The valve cover of claim 7, wherein the enclosed passage and the covering body are formed together in a single molding operation and wherein the valve cover includes a COP boot sealingly coupled inside the COP, the COP boot extending out a top of the COP and above a top surface of the valve cover.

9. The valve cover of claim 7, wherein cover fasteners are used to fasten the valve cover to the cylinder head and seat the molded-in enclosed passage, wherein the enclosed passage is a tube, and wherein the first end of the enclosed passage extends into the sparkplug well formed inside the cylinder head when the valve cover is fastened to the cylinder head.

10. A system for an engine comprising:

a sparkplug attachment site inside a cylinder head;

a valve cover coupled to the cylinder head at a coupling edge of the valve cover and at least partially enclosing a volume between the valve cover and the cylinder head;

at least one sparkplug tube having a first end extending below the coupling edge and into the cylinder head, the first end with an edge disposed to circumscribe the sparkplug attachment site, the first end including a seal to seal an outside of the sparkplug tube with an inside surface of a sparkplug well formed into the cylinder head, where the seal is positioned between the outside of the sparkplug tube and the inside surface of the sparkplug well, and having a second end molded-in to the valve cover, a sealed joint between the sparkplug tube and cover body eliminated; and a Coil On Plug (COP) located within and extending partway out of the sparkplug tube, the COP including a COP boot sealingly coupled inside the COP and extending above a top of the COP and a top surface of the valve cover.

11. The system of claim 10, wherein the O-ring groove includes an O-ring sealingly engaged with an annular surface of the sparkplug well included in the cylinder head.

12. The system of claim 10, wherein the seal includes an O-ring groove formed at the first end of the sparkplug tube.

13. The system of claim 11, wherein the sparkplug well is formed inside the cylinder head and around the sparkplug attachment site and wherein the seal is configured to inhibit movement of oil from inside the volume to the sparkplug attachment site.

14. The system of claim 11, wherein the seal is positioned on the first end of the sparkplug tube below the coupling edge of the valve cover.

15. The system of claim 10, wherein the seal includes a face seal on the edge of the first end of the sparkplug tube for sealingly contacting the cylinder head at a base of the sparkplug tube around the sparkplug attachment site.

16. The system of claim 11, wherein the sparkplug tube extends out and below a bottom surface of the valve cover and into the sparkplug well formed into the cylinder head.

17. The system of claim 11, further comprising a spark plug attached at the sparkplug attachment site, the COP electrically coupled with the spark plug.

18. The system of claim 11, further comprising two or more fastening elements on the valve cover positioned to mate with corresponding two or more fastening elements on the cylinder head to orient the valve cover onto the cylinder head thereby locating the sparkplug tube over the sparkplug attachment site, the system further comprising a sparkplug housed within the sparkplug tube.

19. The system of claim 11, wherein the at least one sparkplug tube is four or more sparkplug tubes each having respective second ends molded-in to the valve cover.

20. The valve cover of claim 6, wherein the seal includes a face seal disposed on an edge of the sparkplug tube and configured for sealing engagement with a base of the sparkplug well.

* * * * *